US007247808B2

(12) United States Patent
Rab et al.

(10) Patent No.: US 7,247,808 B2
(45) Date of Patent: Jul. 24, 2007

(54) ELECTRICAL SERVICE DEVICE HAVING AN ARC PRECHAMBER AREA, ARC GUIDE RAILS AND A CURRENT-LIMITING ARC-QUENCHING DEVICE

(75) Inventors: Alexander Rab, Walldorf (DE); Wolfgang Dorfeld, Dossenheim (DE); Ralf Weber, Heidelberg (DE)

(73) Assignee: ABB Patent GmbH, Ladenburg (DE)

( * ) Notice: Subject to any disclaimer, the term of this patent is extended or adjusted under 35 U.S.C. 154(b) by 0 days.

(21) Appl. No.: 11/350,046

(22) Filed: Feb. 9, 2006

(65) Prior Publication Data

US 2006/0180575 A1 Aug. 17, 2006

(30) Foreign Application Priority Data

Feb. 17, 2005 (DE) ..... 10 2005 007 303

(51) Int. Cl.
*H01H 9/30* (2006.01)

(52) U.S. Cl. ..... 218/34; 218/149

(58) Field of Classification Search ..... 218/34–38, 218/147–149, 151, 156, 157; 335/16, 147, 335/201

See application file for complete search history.

(56) References Cited

U.S. PATENT DOCUMENTS 4,609,797 A * 9/1986 Morton et al. ..... 218/151
4,656,446 A * 4/1987 Chien et al. ..... 335/201
6,262,384 B1 * 7/2001 Niebler et al. ..... 218/156
6,717,090 B2 * 4/2004 Kling et al. ..... 218/151
7,081,596 B2 * 7/2006 Schneider et al. ..... 218/22

FOREIGN PATENT DOCUMENTS

DE 102 42 310 A1 7/2003

* cited by examiner

*Primary Examiner*—Elvin Enad
*Assistant Examiner*—M. Fishman
(74) *Attorney, Agent, or Firm*—Buchanan Ingersoll & Rooney PC

(57) ABSTRACT

The invention proposes an electrical service device, in particular line circuit breaker or motor circuit breaker, having a housing having connecting areas and connection means (2, 3) for the purpose of connecting busbars and/or connection lines on both end sides and, having at least one switching contact having a fixed and a movable contact piece (4, 6), an arc (13) being produced in an arc prechamber area (7) between said fixed and movable contact pieces (4, 6) in the event of a disconnection. The arc enters a current-limiting arc-quenching device (12), in particular an arc splitter stack, via arc guide rails (14, 16), at least one insulating plate (20, 25+26) being arranged at the edge of the arc-quenching device (12). The insulating plate (20, 25+26) is fixed to the end section of an arc guide rail (14) by means of a fixing clip (22).

4 Claims, 2 Drawing Sheets

ELECTRICAL SERVICE DEVICE HAVING AN ARC PRECHAMBER AREA, ARC GUIDE RAILS AND A CURRENT-LIMITING ARC-QUENCHING DEVICE

FIELD

Background Information

Line circuit breakers and motor circuit breakers serve the purpose of isolating electrical lines, which are subjected to excess currents having a high current level, from the power supply system in the event of a fault. For this purpose, a fixed and a movable contact piece are generally provided in an arc prechamber area and are connected to the respective connection terminals. When the switching contact is opened, i.e. when the movable contact piece is lifted off from the fixed contact piece, a switching arc is produced which is quenched in a quenching device provided for this purpose. The arc drawn commutates from the open contact pieces onto arc guide rails in order to then be split in an arc splitter stack (Deion quenching chamber). A high arc voltage is produced there for current limiting purposes such that the arc is extinguished.

DE 102 42 310 A1 has disclosed an arc-quenching arrangement for an electrical switching device which comprises a quenching chamber (in which an arc is produced between a fixed and a movable contact piece in the event of a switching operation) and an arc splitter stack which has two or more arc splitter plates and into which the arc is guided via guide rails. At least one plate made from insulating material—an insulating plate—is arranged within or outside the arc splitter stack, and the outer circumference of this plate does not protrude beyond the outer circumference of the arc splitter plates, and said plate has an inner cutout.

SUMMARY

The invention is based on the object of specifying an electrical service device having an arc prechamber area, arc guide rails and a current-limiting arc-quenching device of the type mentioned initially which provides an optimum mounting option for the insulating plate.

The advantages which can be achieved by the invention consist in particular in the fact that various arc-quenching devices can be used together with the same insulating plate, i.e. it is not necessary to integrate the insulating plate in a special, and therefore cost-intensive, arc-quenching device itself. It is also not necessary to form the insulating plate as part of the housing itself, i.e. it is also possible, for example, to use a thermosetting plastic for the housing (the insulating plate itself is preferably formed from a gas-emitting thermoplastic). There are no restrictions as regards the selection of the thickness of the insulating plate or of the material, and the selection takes place exclusively from the point of view of optimum arc quenching. In this manner, the switching capacity is improved and the disconnection performance is stabilized. The insulating plate can be mounted in a very simple manner. Overall, cost advantages result compared to known embodiments.

Further advantages are described in the description below.

Advantageous refinements of the invention are characterized in the dependent claims.

BRIEF DESCRIPTION OF THE DRAWINGS

The invention will be explained below with reference to the exemplary embodiments illustrated in the drawing, in which.

DETAILED DESCRIPTION

Figure 4:
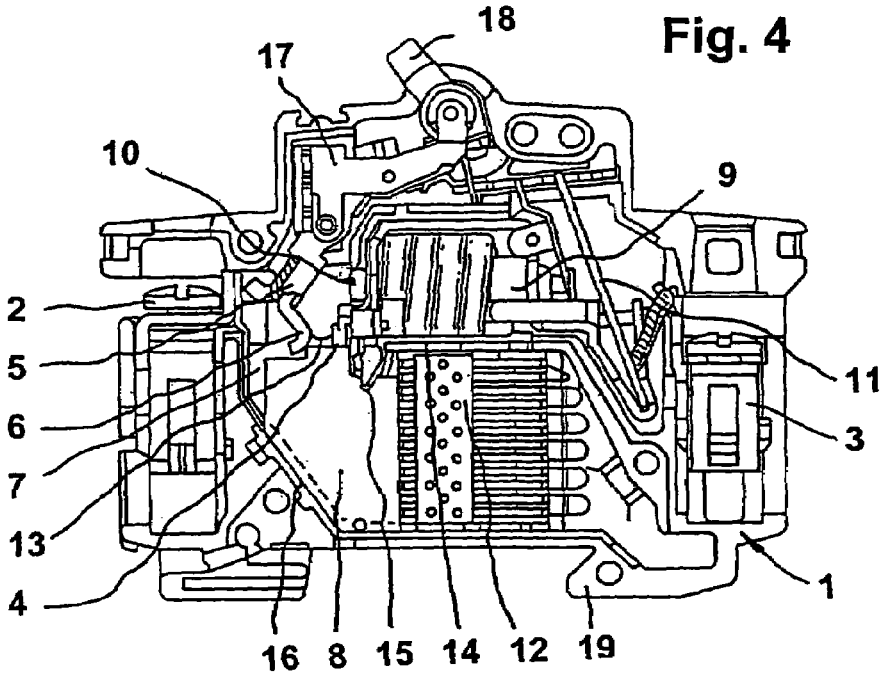
FIG. 4 shows a section through a switching device.

FIG. 4 shows a section through a switching device 1—a line circuit breaker or a motor circuit breaker. Express reference is made to DE 102 42 310 A1 mentioned initially with regard to the design of such an electrical service device which can be mounted on a top-hat mounting rail. Such a switching device has the following components in a narrow, cuboid housing which is made from an electrically insulating plastic material (from a thermoplastic or thermosetting plastic) and generally comprises two halves:

- connecting areas having connection means 2, 3 for the purpose of connecting busbars and/or connection lines (input and output connections) on both end sides,
- at least one switching contact having at least one fixed switching contact piece 4 and at least one movable contact lever 5 having a movable switching contact piece 6 in an arc prechamber area 7,
- prechamber plates 8 close to the two side walls (broad sides) of the arc prechamber area 7,
- an electromagnetic release 9 including an armature 10 for the purpose of disconnecting short-circuit currents,
- a thermal release including a bimetallic strip 11 for the purpose of disconnecting excess currents,
- a current-limiting arc-quenching device, in particular an arc splitter stack 12, at least one insulating plate (cf. numerals 20 and 25/26) being arranged at the edge of the arc-quenching device 12, the outer circumference of said insulating plate not protruding beyond the outer circumference of the arc splitter plates, and the insulating plate having an inner cutout,
- arc rails for the purpose of guiding an arc 13 produced between the fixed switching contact piece 4 and the movable switching contact piece 6 from the point at which it was produced in the arc prechamber area 7 into the arc-quenching device 12, to be precise an arc guide rail 14, which is electrically connected to the fixed switching contact piece 4, including an arcing horn 15 protruding into the arc prechamber area 7 and an arc guide rail 16 which is electrically connected to the movable switching contact piece 6,
- a switching mechanism 17 which is acted on by the electromagnetic release and the thermal release,
- a switching toggle 18, which is to be used for manual switching operations and likewise acts on the switching mechanism 17, on the upper side of the housing,
- mounting means (fixed tab+movable tab) 19 for the purpose of fixing the switching device 1 on a top-hat mounting rail on the base of the housing.

If more than one switching contact having a fixed and a movable switching contact piece is provided, arc splitter stacks including arc guide rails are of course also provided in a corresponding number.

Figure 1:
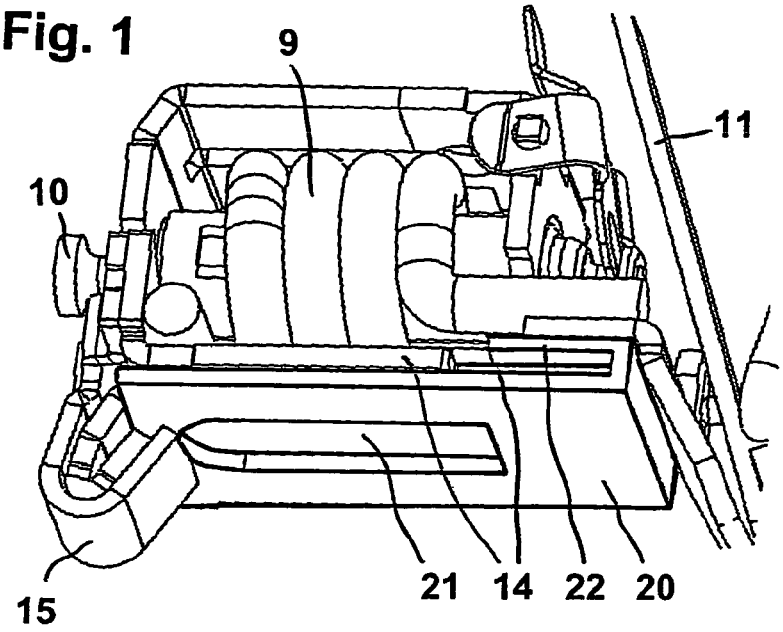
FIGS. 1, 2, 3 show different embodiments of an insulating plate.
Figure 2:
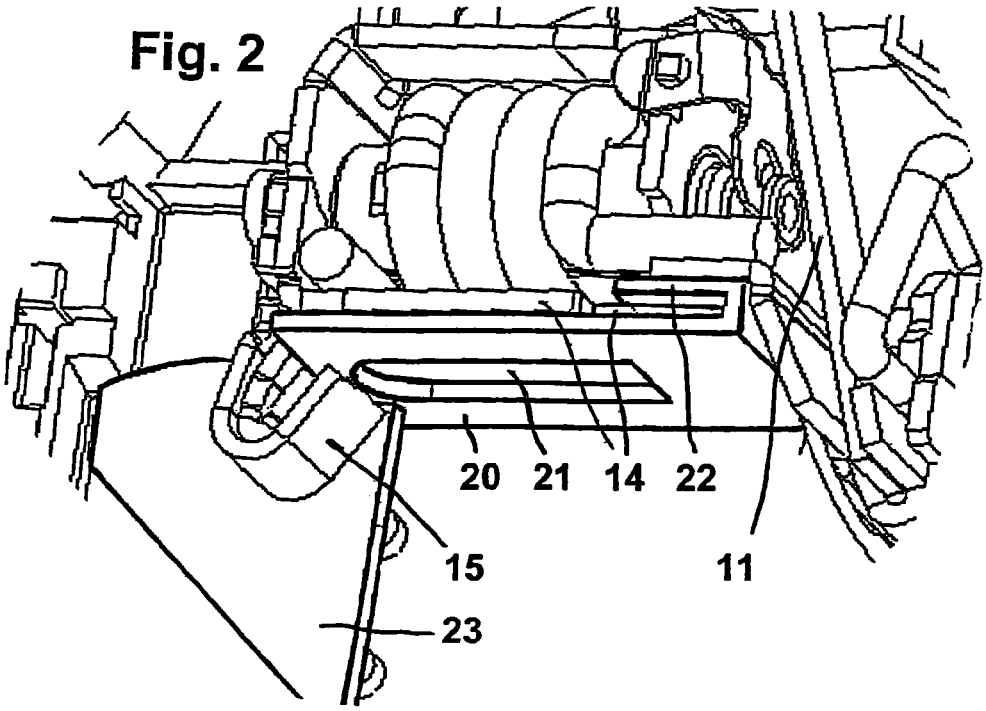
Figure 3:
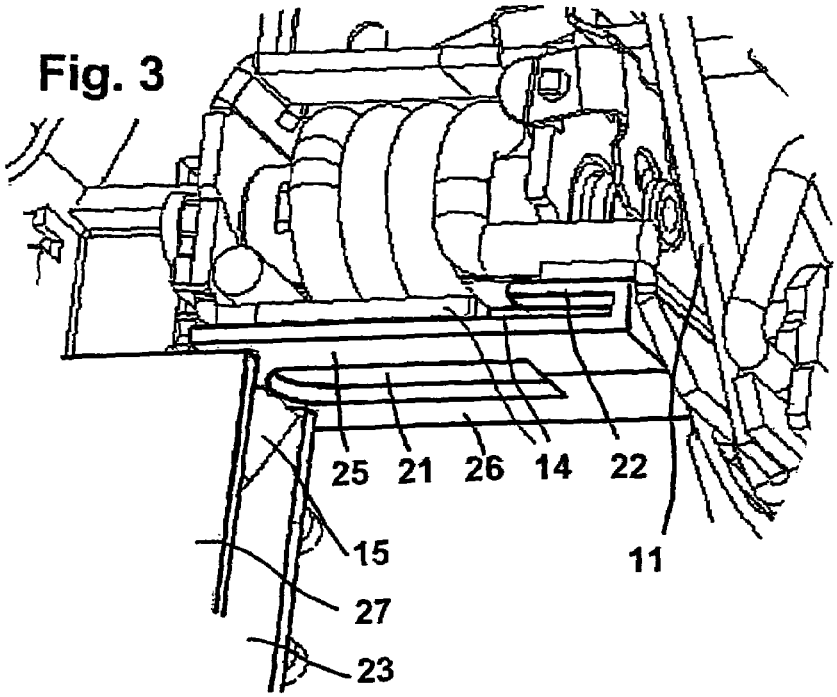

FIGS. 1, 2 and 3 show various embodiments of an insulating plate. In the embodiment shown in FIG. 1, an insulating plate 20 having a cutout 21 and an end-side (integrally formed) fixing clip 22 is provided, this fixing clip 22 engaging in the form of a U around the end section of the arc guide rail 14, as a result of which the insulating plate 20 is fixed in a latching manner to the component (electromagnetic release 9/fixed switching contact piece 4/arc guide rail 14). The "input-side" section, which faces the arc prechamber area 7, of the insulating plate 20 engages below the arcing horn 15 and provides an additional means for holding the insulating plate 20. Also shown are the electromagnetic release 9 with the armature 10 and the bimetallic strip 11.

In the embodiment shown in FIG. 2, the insulating plate 20 (including the integrally formed fixing clip 22) is manufactured, together with a prechamber plate 23, as an integral component from a gas-emitting plastic, as a result of which, when the insulating plate 20 is fixed by means of the fixing clip 22 engaging around the arc guide rail 14, the prechamber plate 23 is advantageously also fixed at the same time. Overall, this embodiment is very installation-friendly and has a reduced number of parts. Finally, this results in cost advantages.

In the embodiment shown in FIG. 3, a prechamber plate 23 or 27 is provided on each side wall (broad side) of the arc prechamber area 7. The insulating plate comprises two insulating-plate halves 25 and 26 which each have an integrally formed fixing clip 22. In this case, the insulating plate is split into two halves along a partition axis extending parallel to, and inbetween, its longitudinal sides. During installation, the two plate parts then join along the partition axis in a seamless manner to form the complete plate. The arcing horn 15 is arranged between the two prechamber plates 23, 27. The following are manufactured as integral components from a gas-emitting plastic:

insulating-plate half 25 having a prechamber plate 27, insulating-plate half 26 having a prechamber plate 23.

It is true for all embodiments shown in FIGS. 1-3 that the insulating plate 20 or the insulating-plate halves 25+26 improve the stable burning of the arc 13 within the arc-quenching device 12 (stabilization of the arc base point after entry into the arc-quenching device). The cutout 21 in the insulating plate advantageously need not be matched to the cutout in the individual arc splitter plates of the arc splitter stack. Instead, the cutout 21 is selected such that it achieves optimization as regards the quenching behaviour of the arc 13.

In the exemplary embodiments explained above, the insulating plate 20 or the two insulating-plate halves 25, 26 is or are fixed to the arc guide rail 14, which is connected to the fixed switching contact piece 4. As an alternative, it is of course also possible for it or them to be fixed to the arc guide rail 16, which is connected to the movable switching contact piece 6, or for insulating plates to be fixed to the two arc guide rails 14, 16.

LIST OF REFERENCES

1 Switching device
2 Connection means
3 Connection means
4 Fixed switching contact piece
5 Movable contact lever
6 Movable switching contact piece
7 Arc prechamber area
8 Prechamber plates
9 Electromagnetic release
10 Armature
11 Bimetallic strip
12 Arc-quenching device
13 Arc
14 Arc guide rail
15 Arcing horn
16 Arc guide rail
17 Switching mechanism
18 Switching toggle
19 Installation means
20 Insulating plate
21 Cutout
22 Fixing clip
23 Prechamber plate
24 -
25 Insulating-plate half
26 Insulating-plate half
27 Prechamber plate

The invention claimed is:

1. An electrical service device, in particular line circuit breaker or motor circuit breaker, having a housing having connecting areas and connection means for the purpose of connecting busbars and/or connection lines on both end sides, having at least one switching contact having fixed and movable switching contact pieces, an arc being produced in an arc prechamber area between said fixed and movable switching contact pieces in the event of a disconnection, said arc entering a current-limiting arc-quenching device, in particular an arc splitter stack, via arc guide rails, at least one insulating plate being arranged at the edge of the arc-quenching device, wherein the at least one insulating plate is fixed to the end section of an arc guide rail by means of an integrally formed, U-shaped fixing clip.

2. The electrical service device according to claim 1, wherein the insulating plate is formed, together with a prechamber plate, as an integrally formed component.

3. The electrical service device according to claim 1, wherein the insulating plate comprises two insulating-plate halves which each have a fixing clip.

4. The electrical service device according to claim 3, wherein each insulating-plate half is formed, together with a prechamber plate, as an integrally formed component.

* * * * *